US008821707B2

(12) United States Patent
Inoue et al.

(10) Patent No.: US 8,821,707 B2
(45) Date of Patent: Sep. 2, 2014

(54) ELECTRIC AL OR AL ALLOY PLATING BATH USING ROOM TEMPERATURE MOLTEN SALT BATH AND PLATING METHOD USING THE SAME

(75) Inventors: Manabu Inoue, Tokyo (JP); Tadahiro Ohnuma, Tokyo (JP); Tsutomu Miyadera, Wako (JP)

(73) Assignees: Dipsol Chemicals Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 194 days.

(21) Appl. No.: 12/850,081

(22) Filed: Aug. 4, 2010

(65) Prior Publication Data

US 2012/0031766 A1 Feb. 9, 2012

(51) Int. Cl.

| | |
|---|---|
| ***C25D 3/44*** | (2006.01) |
| ***C25D 3/56*** | (2006.01) |
| ***C25D 3/66*** | (2006.01) |
| ***C25D 5/18*** | (2006.01) |

(52) U.S. Cl.
CPC *C25D 3/665* (2013.01); *C25D 3/44* (2013.01); *C25D 3/56* (2013.01); *C25D 5/18* (2013.01)
USPC ..... 205/104; 205/232; 205/233; 205/236

(58) Field of Classification Search
USPC ..... 205/232, 233
See application file for complete search history.

(56) References Cited

U.S. PATENT DOCUMENTS

| | | | | |
|---|---|---|---|---|
| 3,997,410 | A * | 12/1976 | Gileadi et al. | 205/237 |
| 4,747,916 | A * | 5/1988 | Kato et al. | 205/104 |
| 4,904,355 | A * | 2/1990 | Takahashi | 205/233 |

FOREIGN PATENT DOCUMENTS

| | | | |
|---|---|---|---|
| JP | 62-70592 | A | 4/1987 |
| JP | 2-133596 | A | 5/1990 |
| JP | 4-72089 | A | 3/1992 |

(Continued)

OTHER PUBLICATIONS

Tsuda, Tetsuya et al., "Electrodeposition of Al-Zr Alloys from Lewis Acidic Aluminum Chloride-1-Ethyl-3-methylimidazolium Chloride Melt", Journal of The Electrochemical Society, 151 (7), C447-C454, (2004).

(Continued)

*Primary Examiner* — James Lin
*Assistant Examiner* — William Leader
(74) *Attorney, Agent, or Firm* — Hoffman & Baron, LLP

(57) ABSTRACT

Disclosed herein is an electric Al or Al alloy plating bath which comprises (A) an aluminum halide; (B) one kind of compound or at least two kinds of compounds selected from the group consisting of N-alkylpyridinium halides, N-alkylimidazolium halides, N,N'-alkylimidazolium halides, N-alkyl-pyrazolium halides, N,N'-alkylpyrazolium halides, N-alkylpyrrolidinium halides and N,N-alkyl-pyrrolidinium halides; and (C) a high boiling point aromatic hydrocarbon solvent, wherein the molar ratio of the aluminum halide (A) to the compound (B) ranges from 1:1 to 3:1 and the flash point of the plating bath is not less than 50° C. The plating bath never involves any risk of causing an explosion, can be handled industrially with safety and can provide a smooth and fine Al of Al alloy plated film. Moreover, the resulting film has high resistance to corrosion even when it does not contain any chromium and therefore, it is quite suitable from the viewpoint of the environmental protection and it can thus be used in a wide variety of applications including the plating of parts for motorcars, and the plating of parts for electrical appliances.

6 Claims, No Drawings

(56) References Cited

FOREIGN PATENT DOCUMENTS

| | | | | |
|---|---|---|---|---|
| JP | 5-51785 | A | | 3/1993 |
| JP | 2008-195988 | A | | 8/2008 |
| JP | 2008-195990 | | * | 8/2008 |
| JP | 2009-197318 | A | | 9/2009 |

OTHER PUBLICATIONS

Office Action issued in Japanese Patent Application No. 2008-011962, mailed Sep. 18, 2012.

* cited by examiner

ELECTRIC AL OR AL ALLOY PLATING BATH USING ROOM TEMPERATURE MOLTEN SALT BATH AND PLATING METHOD USING THE SAME

BACKGROUND OF THE INVENTION

1. Field of the Invention

The present invention relates to an electric Al or Al alloy plating bath which can be used at ordinary temperature. More particularly, the present invention relates to an electric Al or Al alloy plating bath for forming an electric Al or Al alloy plated layer, which can be used as a usual surface treatment for the prevention of the occurrence of any corrosion.

2. Brief Description of the Related Art

It has been well-known that an aluminum metal material shows excellent anti-corrosive properties, but aluminum has a strong affinity for oxygen and the reduction potential thereof is inferior to that of hydrogen. For this reason, the electro-deposition of an aluminum layer from an aqueous solution containing the same is quite difficult. Therefore, the electro-plating of aluminum has long been put into practice while using an organic solvent-based plating bath or a high temperature molten salt bath. Typical examples of such organic solvent-based plating baths include those obtained by dissolving $AlCl_3$ and $LiAlH_4$ or LiH in ether; those obtained by dissolving these components in tetrahydrofuran; and solutions of $NaF.2Al(C_2H_5)_3$ in toluene. However, these baths suffer from a problem such that the handling thereof is quite difficult, since it may involve a risk of causing an explosion when it is brought into contact with the air or water. Thus, there has been proposed a mixed molten salt bath comprising an aluminum halide and an alkylpyridinium halide as a bath free of any risk of causing an explosion (see Patent Document 1 specified below). Moreover, there has also been proposed a molten salt bath comprising an aluminum halide and an alkyl imidazolium halide, which is further blended with a zirconium halide (see Non-patent Document 1 specified below). However, the plating of aluminum from such an Al—Zr alloy plating bath results in the formation of an electro-deposited layer which is non-uniform and insufficient in the smoothness. In particular, when increasing the thickness of the plated layer and/or when increasing the current density, a problem arises such that a dendritic deposit is formed at high current density portions and the deposit thus formed is easily peeled off from the surface of a substrate. Contrary to this, when reducing the current density used, another problem arises such that the throwing power is reduced and this accordingly results in the formation of areas free of any deposit layer. Moreover, if the resulting plated film is subjected to, for instance, the salt spray test without subjecting the film to a chromate-treatment which makes use of chromium (VI)-containing compound, the film is easily dissolved in the salt solution, never ensures the expected anti-corrosive power and accordingly, it would be quite difficult to obtain a highly anti-corrosive Al or Al alloy plated film. To solve such a problem associated with the foregoing molten salt bath, the inventors of this invention has previously proposed a method for diluting such a molten salt bath by the addition of a general-purpose aromatic solvent such as benzene, toluene or xylene (see Japanese Patent Application No. 2007-030553). The addition of, for instance, benzene, toluene or xylene would permit the improvement of even the throwing power without unreasonably reducing the electric conductivity of the molten salt. When using such an aromatic solvent in an industrial scale, however, a problem arises such that one should take measures to ensure the safety of human body because of their high volatility and that it is also necessary to take measures against the risk of catching fire because of their high flash point.

Patent Document 1: JP-A-62-70592

Non-patent Document 1: Journal of The Electrochemical Society, 2004, 151(7), C447-C454 (2004).

SUMMARY OF THE INVENTION

Accordingly, it is an object of the present invention to provide an electric Al or Al alloy plating bath (i) which never involves any risk of causing an explosion even when it comes in close contact with the air or water, (ii) which can be handled industrially with safety, (iii) which is never accompanied by the formation of any dendritic deposit even at high current density portions, which can ensure the excellent throwing power and form a smooth and uniform plated film even on the low current density area and (iv) which can also provide a plated film having high corrosion resistance even when the film is not subjected to any chromate-treatment.

The electric Al or Al alloy plating bath of the present invention comprises (A) an aluminum halide; (B) one kind of compound or at least two kinds of compounds selected from the group consisting of N-alkylpyridinium halides, N-alkylimidazolium halides, N,N'-dialkylimidazolium halides, N-alkyl-pyrazolium halides, N,N'-dialkylpyrazolium halides, N-alkylpyrrolidinium halides and N,N-dialkylpyrrolidinium halides; and (C) a high boiling point aromatic hydrocarbon solvent, in which the molar ratio of the aluminum halide (A) to the compound (B) ranges from 1:1 to 3:1; and the flash point of the plating bath is not less than 50° C.

The present invention further provides an electro-plating method comprising the step of carrying out the electric plating by using the foregoing electric Al or Al alloy plating bath.

The plating bath according to the present invention never involves any risk of causing an explosion, can be handled industrially with safety and can provide a smooth and fine Al of Al alloy plated film. Moreover, the resulting film has high resistance to corrosion even when it does not contain any chromium and therefore, it is quite suitable from the viewpoint of the environmental protection and it can thus be used in a wide variety of applications including the plating of parts for motorcars, and the plating of parts for electrical appliances.

DESCRIPTION OF THE PREFERRED EMBODIMENTS

The electric Al or Al alloy plating bath of the present invention comprises (A) an aluminum halide; (B) one kind of compound or at least two kinds of compounds selected from the group consisting of N-alkylpyridinium halides, N-alkylimidazolium halides, N,N'-dialkyl-imidazolium halides, N-alkyl-pyrazolium halides, N,N'-dialkyl-pyrazolium halides, N-alkylpyrrolidinium halides and N,N-dialkyl-pyrrolidinium halides; and (C) a high boiling point aromatic hydrocarbon solvent.

The aluminum halide (A) used in the present invention is represented by the general formula: $AlX_3$, wherein X represents a halogen atom such as a fluorine atom, a chlorine atom, a bromine atom or an iodine atom, with a chlorine or bromine atom being preferably used herein. A chlorine atom is most preferably used herein from the economical standpoint.

The N-alkylpyridinium halides used in the present invention as the compound (B) may have an alkyl substituent in the pyridinium skeleton and, for example, can be represented by the following general formula (I):

(I)

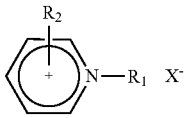

In the formula, $R_1$ represents a linear, branched or cyclic alkyl group having 1 to 12 carbon atoms and preferably a linear or branched alkyl group having 1 to 5 carbon atoms; $R_2$ represents a hydrogen atom or a linear, branched or cyclic alkyl group having 1 to 6 carbon atoms and preferably a linear or branched alkyl group having 1 to 3 carbon atoms; and X represents a halogen atom, with a bromine atom being most preferred as the halogen atom, while taking into consideration the reactivity.

Specific examples of such N-alkyl pyridinium halides include N-methylpyridinium chloride, N-methylpyridinium bromide, N-ethyl-pyridinium chloride, N-ethylpyridinium bromide, N-butylpyridinium chloride, N-butylpyridinium bromide, N-hexylpyridinium chloride, N-hexylpyridinium bromide, 2-methyl-N-propylpyridinium chloride, 2-methyl-N-propylpyridinium bromide, 3-methyl-N-ethylpyridinium chloride and 3-methyl-N-ethylpyridinium bromide.

The N-alkyl imidazolium halides and N,N'-dialkyl imidazolium halides used in the present invention as the compound (B) may be, for instance, represented by the following general formula (II):

(II)

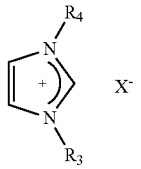

In the formula, $R_3$ represents a linear, branched or cyclic alkyl group having 1 to 12 carbon atoms and preferably a linear or branched alkyl group having 1 to 5 carbon atoms; $R_4$ represents a hydrogen atom or a linear, branched or cyclic alkyl group having 1 to 6 carbon atoms and preferably a hydrogen atom or a linear or branched alkyl group having 1 to 3 carbon atoms; and X represents a halogen atom, with a bromine atom being most preferred as the halogen atom, while taking into consideration the reactivity.

Specific examples of the foregoing N-alkyl imidazolium halides and N,N'-dialkyl imidazolium halides include 1-methylimidazolium chloride, 1-methylimidazolium bromide, 1-ethylimidazolium chloride, 1-ethyl imidazolium bromide, 1-propylimidazolium chloride, 1-propylimidazolium bromide, 1-octylimidazolium chloride, 1-octylimidazolium bromide, 1-methyl-3-ethylimidazolium chloride, 1-methyl-3-ethylimidazolium bromide, 1,3-dimethylimidazolium chloride, 1,3-dimethylimidazolium bromide, 1,3-diethylimidazolium chloride, 1,3-diethylimidazolium bromide, 1-methyl-3-propylimidazolium chloride, 1-methyl-3-propylimidazolium bromide, 1-butyl-3-butylimidazolium chloride, and 1-butyl-3-butyl imidazolium bromide.

The N-alkylpyrazolium halides and N,N'-dialkyl-pyrazolium halides used in the present invention as the compound (B) are, for instance, represented by the following general formula (III):

(III)

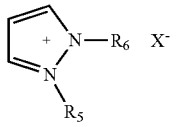

In the formula, $R_5$ represents a linear, branched or cyclic alkyl group having 1 to 12 carbon atoms and preferably a linear or branched alkyl group having 1 to 5 carbon atoms; $R_6$ represents a hydrogen atom or a linear, branched or cyclic alkyl group having 1 to 6 carbon atoms and preferably a hydrogen atom or a linear or branched alkyl group having 1 to 3 carbon atoms; and X represents a halogen atom, with a bromine atom being most preferred as the halogen atom, while taking into consideration the reactivity.

Specific examples of the foregoing N-alkylpyrazolium halides and N,N'-dialkylpyrazolium halides include 1-methylpyrazolium chloride, 1-methylpyrazolium bromide, 1-propylpyrazolium chloride, 1-propyl pyrazolium bromide, 1-butylpyrazolium chloride, 1-butylpyrazolium bromide, 1-hexylpyrazolium chloride, 1-hexylpyrazolium bromide, 1-methyl-2-ethylpyrazolium chloride, 1-methyl-2-ethylpyrazolium bromide, 1-methyl-2-propylpyrazolium chloride, 1-methyl-2-propylpyrazolium bromide, 1-propyl-2-methylpyrazolium chloride, 1-propyl-2-methylpyrazolium bromide, 1-butyl-2-methylpyrazolium chloride, 1-butyl-2-methylpyrazolium bromide, 1-hexyl-2-methylpyrazolium chloride, 1-hexyl-2-methylpyrazolium bromide, 1,2-dimethylpyrazolium chloride, 1,2-dimethylpyrazolium bromide, 1,2-diethylpyrazolium chloride and 1,2-diethylpyrazolium bromide.

The N-alkylpyrrolidinium halides and N,N-dialkyl-pyrrolidinium halides used in the present invention as the compound (B) are, for instance, represented by the following general formula (IV):

(IV)

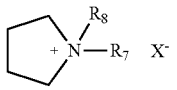

In the formula, $R_7$ represents a hydrogen atom or a linear, branched or cyclic alkyl group having 1 to 12 carbon atoms and preferably a linear or branched alkyl group having 1 to 5 carbon atoms, $R_8$ represents a hydrogen atom or a linear, branched or cyclic alkyl group having 1 to 6 carbon atoms and preferably a hydrogen atom or a linear or branched alkyl group having 1 to 3 carbon atoms, provided that $R_7$ and $R_8$ do not simultaneously represent hydrogen atoms, and X represents a halogen atom, with a bromine atom being most preferred as the halogen atom, while taking into consideration the reactivity.

Specific examples of the foregoing N-alkylpyrrolidinium halides and N,N-dialkyl-pyrrolidinium halides include 1-methylpyrrolidinium chloride, 1-methylpyrrolidinium bromide, 1,1-dimethylpyrrolidinium chloride, 1-ethyl-1-methylpyrrolidinium chloride, 1-ethylpyrrolidinium chloride, 1-propylpyridinium chloride, 1-methyl-1-propylpyridinium chloride, 1-butyl-1-methylpyrrolidinium chloride, 1-ethyl-1-propylpyridinium chloride, 1-methyl-1-hexylpyridinium chloride, 1-butylpyrrolidinium chloride, and 1-ethyl-1-methylpyridinium chloride.

Moreover, the compound (B) may be a mixture of at least two kinds of compounds selected from the foregoing N-alkylpyridinium halides, N-alkylimidazolium halides, N,N'-dialkyl-imidazolium halides, N-alkyl-pyrazolium halides, N,N'-dialkyl-pyrazolium halides, N-alkylpyrrolidinium halides and N,N-dialkyl-pyrrolidinium halides and further the compound (B) may be a mixture of at least two kinds of these compounds whose halogen atoms are different from one another.

In the present invention, the ratio of the molar number of the aluminum halide (A) to that of the compound (B) preferably ranges from 1:1 to 3:1 and more preferably 2:1. The use of these components in such a molar ratio specified above would permit the prevention of the occurrence of any reaction which may be suspected to be the decomposition of pyridinium, imidazolium, pyrazolium or pyrrolidinium cations and likewise permit the prevention of the deterioration of the plating bath and the prevention of the occurrence of any insufficient plating due to the increase in the viscosity of the plating bath.

The high boiling point aromatic hydrocarbon solvent (C) used in the present invention is not restricted to any particular one inasmuch as it is soluble in a molten salt and it never results in the reduction of the electric conductivity of the molten salt, but the aromatic hydrocarbon solvent is preferably one having a boiling point of not less than 160° C. (as determined at atmospheric pressure) and is preferably an alkyl-substituted and/or hydroxy-substituted aromatic hydrocarbon solvent. In this respect, the alkyl group may be, for instance, a linear, branched or cyclic alkyl group having 1 to 12 carbon atoms. Moreover, examples of the aromatic nuclei of the solvents include benzene, indene, indane, tetralin, naphthalene, and fluorene nuclei. Specific examples thereof include aromatic nuclei derived from 1,2,3-trimethylbenzene, 1,2,4-trimethyl-benzene, 1,2,3,4-tetramethyl-benzene, 1,2,3,5-tetramethyl-benzene, 1,2,4,5-tetramethylbenzene, 1,3-di-ethylbenzene, p-cymene, 4-propyltoluene, n-butylbenzene, 3-butyltoluene, 1-ethyl-4-isopropylbenzene, 3,5-diethyltoluene, 1,3,5-triethylbenzene, 1,3-di-propylbenzene, 5-tert-butyl-1,3-dimethyl-benzene, n-pentylbenzene, n-octyl-benzene, cyclohexyl-benzene, hydroxyindane, methylindane, dimethylindane, ethylindane, methyl-naphthalene, dimethyl-naphthalene, and 1,2,3,4-tetra-hydro-naphthalene. These solvents may be used alone or in any combination of at least two of them. Among these aromatic hydrocarbon solvents, preferably used herein are alkyl-substituted and/or hydroxy-substituted benzenes or naphthalenes, with alkyl-substituted benzene or hydroxy-substituted naphthalene being most preferably used herein among others. In addition, the concentration of such a high boiling point aromatic hydrocarbon solvent to be incorporated into the plating bath is preferably less than 50% by volume, it more preferably ranges from 1 to 50% by volume, further preferably 5 to 25% by volume and most preferably 10 to 20% by volume. If the high boiling point aromatic hydrocarbon solvent (C) is used in an amount falling within the range specified above, the flash point of the resulting electric Al or Al alloy plating bath according to the present invention is not less than 50° C., preferably not less than 55° C., and more preferably not less than 61° C. (as determined at atmospheric pressure) and further the throwing power of the resulting plating bath is improved, the use of the aromatic solvent in such an amount would likewise permit the improvement of the corrosion resistance of the resulting plating bath, the formation of a uniform electro-plated layer. The use of the aromatic hydrocarbon solvent never leads to any reduction of the electrical conductivity of the bath and does not increase the risk of catching fire because of its high flash point.

The electric Al or Al alloy plating bath of the present invention may further comprise (D) one kind of compound or at least two kinds of organic polymers selected from the group consisting of styrenic polymers and aliphatic diene-derived polymers. Specific examples of the styrenic polymers used as the organic polymers (D) in the present invention are styrenic homopolymers of styrenic monomers such as styrene, α-methylstyrene, vinyltoluene, and m-methylstyrene, copolymers of these styrenic monomers and copolymers of these styrenic monomers and other polymerizable vinylic monomers. Examples of the foregoing vinylic monomers include maleic anhydride, maleic acid, acrylic acid, methacrylic acid, methyl methacrylate, glycidyl methacrylate, itaconic acid, acrylamide, acrylonitrile, maleimide, vinyl pyridine, vinyl carbazole, acrylic acid esters, methacrylic acid esters, fumaric acid esters, vinyl ethyl ether, and vinyl chloride. Among them, α, β-unsaturated carboxylic acids having 3 to 10 carbon atoms or alkyl (having 1 to 3 carbon atoms) esters thereof are preferable.

In addition, examples of the aliphatic diene-derived polymers used as the organic polymers (D) in the present invention include polymers derived from monomers such as butadiene, isoprene and pentadiene. Among them, polymers each having a branched chain in the form of a 1,2- or 3,4-structure, or copolymers of these monomers with other polymerizable vinylic monomers are preferable. Examples of the foregoing vinylic monomers include those described above in connection with the foregoing styrenic polymers.

The weight average molecular weight of the organic polymer (D) preferably ranges from 200 to 80,000. In particular, polystyrenes and poly(α-methylstyrenes) each having a low to medium weight average molecular weight on the order of 300 to 5,000 are most preferable because of its excellent solubility in the molten salt. The concentration thereof in the resulting plating bath preferably ranges from 0.1 to 50 g/L and more preferably 1 to 10 g/L. The use of the organic polymer (D) in such a concentration specified above would permit the prevention of the formation of any dendritic deposit, ensure the achievement of the desired surface-smoothening effect and likewise permit the prevention of the occurrence of any burning of the plated film.

The electric Al or Al alloy plating bath according to the present invention may further comprise brightening agent (E). The brightening agent (E) may be, for instance, one kind of compound or at least two kinds of compounds selected from the group consisting of aliphatic aldehydes, aromatic aldehydes, aromatic ketones, nitrogen atom-containing unsaturated heterocyclic compounds, hydrazide compounds, sulfur atom-containing heterocyclic compounds, aromatic hydrocarbons each carrying a sulfur atom-containing substituent, aromatic carboxylic acids and derivatives thereof, aliphatic carboxylic acids each having a double bond and derivatives thereof, acetylene alcohol compounds and trifluoro-chloro-ethylenic resins.

The aliphatic aldehyde may be, for instance, those having 2 to 12 carbon atoms and specific examples thereof are tribromo-acetaldehyde, metaldehyde, 2-ethylhexylaldehyde, and lauryl-aldehyde.

The aromatic aldehyde may be, for instance, those having 7 to 10 carbon atoms and specific examples thereof are o-carboxy-benzaldehyde, benzaldehyde, o-chloro-benzaldehyde, p-tolualdehyde, anisaldehyde, p-dimethylamino-benzaldehyde, and terephthaldehyde.

The aromatic ketones may be, for instance, those having 8 to 14 carbon atoms and specific examples thereof are benzalacetone, benzo-phenone, acetophenone and terephthaloyl benzyl chloride.

The nitrogen atom-containing unsaturated heterocyclic compound may be, for instance, those having 3 to 14 carbon atoms and specific examples thereof are pyrimidine, pyrazine, pyridazine, s-triazine, quinoxaline, phthalazine, 1,10-phenanthroline, 1,2,3-benzotriazole, acetoguanamine, cyanuric chloride, and imidazole-4-acrylic acid.

The hydrazide compound may be, for instance, maleic acid hydrazide, isonicotinic acid hydrazide, and phthalic acid hydrazide.

The sulfur atom-containing heterocyclic compound may be, for instance, those having 3 to 14 carbon atoms and specific examples thereof are thiouracil, thionicotinic acid amide, S-trithiane, 2-mercapto-4,6-dimethyl-pyrimidine.

The aromatic hydrocarbons each carrying a sulfur atom-containing substituent may be, for instance, those having 7 to 20 carbon atoms and specific examples thereof include thiobenzoic acid, thioindigo, thioindoxyl, thioxanthene, thioxanthone, 2-thiocoumarin, thiocresol, thiodiphenyl amine, thionaphthol, thiophenol, thiobenzamide, thiobenzanilide, thio-benzaldehyde, thio-naphthene-quinone, thio-naphthene, and thio-acetanilide.

The aromatic carboxylic acids and derivatives thereof may be, for instance, those having 7 to 15 carbon atoms and derivatives thereof, and specific examples thereof are benzoic acids, terephthalic acid, and ethyl benzoate.

The aliphatic carboxylic acids each having a double bond and derivatives thereof may be, for instance, those each having a double bond and 3 to 12 carbon atoms and derivatives thereof, and specific examples thereof are acrylic acid, crotonic acid, methacrylic acid, acrylic acid-2-ethylhexyl, and methacrylic acid-2-ethylhexyl.

The acetylene alcohol compound may be, for instance, propargyl alcohol.

The fluororesin may be, for instance, trifluoro-chloro-ethylenic resins each having an average molecular weight ranging from 500 to 1,300.

The concentration of the brightening agent (E) in the plating bath preferably ranges from 0.001 to 0.1 mole/L and more preferably 0.002 to 0.02 mole/L. If the brightening agent (E) is used in the electric Al or Al alloy plating bath of the present invention in such a concentration specified above, the achievement of an intended smoothening effect can be ensured and there is not observed the formation of any black smut-like deposit even when the plating is carried out at a high current density.

The electric Al or Al alloy plating bath according to the present invention may likewise comprise an organic polymer (D) or a brightening agent (E) in addition to the foregoing essential components and in this respect, the organic polymer (D) and the brightening agent (E) can simultaneously be incorporated into the plating bath.

In addition, the electric Al or Al alloy plating bath according to the present invention may comprise (F) a salt of one kind of compound or at least two kinds of metals selected from the group consisting of Zr, Ti, Mo, W, Mn, Ni, Co, Sn, Cu and Zn and/or an Si atom-containing compound. The use of the foregoing metal salt or the Si atom-containing compound in the electric Al or Al alloy plating bath of the present invention would permit the formation of a plating layer of the alloy of Al with the added metal or Si. For instance, the Al-plated layer obtained using $ZrCl_4$ is an Al—Zr alloy plated one and the use of such an additive can improve the corrosion resistance of the resulting plated layer. As the foregoing salts of metals, preferred are halides of the metals, with chlorides being preferred from the standpoint of easy handleability thereof, among others. Specific examples of such metal salts are titanium chloride, molybdenum bromide, manganese iodide, nickel bromide, cobalt chloride, and tungsten fluoride. Moreover, specific examples of the foregoing Si atom-containing compounds include fine powder of $SiO_2$ and colloidal silica.

The concentration of the foregoing metal salt to be incorporated into the plating bath preferably ranges from 0.5 to 100 g/L, more preferably 1 to 50 g/L and further preferably 5 to 20 g/L. If the foregoing metal salt is used in the electric Al or Al alloy plating bath according to the present invention in a concentration specified above, the resulting plating bath can provide an alloy plated layer excellent in the corrosion resistance and it never undergoes the formation of any black-colored powdery deposit.

An example of the plating method which makes use of the electric Al or Al alloy plating bath according to the present invention is an electro-plating method. The electro-plating method can be carried out using a direct current or a pulsed current, but the use of a pulsed current is particularly preferable. In this connection, it is preferred to use a pulsed current under the following conditions: a duty ratio (ON/OFF ratio) preferably ranging from 1:2 to 2:1 and most preferably 1:1; an ON time ranging from 5 to 20 ms; and an OFF time ranging from 5 to 20 ms, since the electrodeposited particles thus formed are densified and smoothened. The bath temperature used herein usually ranges from 25 to 120° C. and preferably 50 to 80° C. The current density as an electrolysis condition in general ranges from 0.1 to 15 A/dm$^2$ and preferably 0.5 to 5 A/dm$^2$. In this respect, the electric Al or Al alloy plating bath according to the present invention is safe even when it is brought into contact with oxygen or moisture, but the electroplating method is desirably carried out in a dry, oxygen-free atmosphere (for instance, in a dry nitrogen gas atmosphere or dry argon gas atmosphere) for the purpose of maintaining the stability of the plating bath and of ensuring the desired quality of the resulting plated layer. Moreover, when putting the electric plating procedure into practice, it is desirable that the bath liquid is stirred or/and the subject to be plated is oscillated. For instance, the current density can further be increased by stirring the bath liquid through the use of a jet stream or the application of ultrasonic waves.

In this respect, however, when plating a part having a complicated shape, it is desirable to omit the stirring operation or weaken the strength of the stirring and to carry out the plating at a low cathode current density on the order of 0.5 to 1 A/dm$^2$ for a long period of time for the improvement of the throwing power. The anode to be used herein may be an insoluble one. In this connection, however, it is necessary to maintain the composition of the bath liquid to a desired constant level by the supplementation of, for instance, an aluminum halide.

The use of the electric Al or Al alloy plating bath according to the present invention would permit the application of a densified and smooth Al or Al alloy plated film onto the surface of a variety of metals or ceramics such as iron, zinc and ceramics.

The rate of the Zr-co-deposition in the Al—Zr alloy plated film which is obtained through the use of an electric Al—Zr alloy plating bath prepared by the incorporation of, for instance, $ZrCl_4$ into the electric Al alloy plating bath according to the present invention is preferably in the range of from 1 to 40% by mass, more preferably 3 to 35% by mass and most preferably 10 to 30% by mass. The corrosion resistance of the resulting Al—Zr alloy plated film is considerably improved if the Zr-co-deposition rate is set at a level specified above.

The thickness of the Al or Al alloy plated film obtained through the use of the electric Al or Al alloy plating bath according to the present invention usually ranges from 1 to 50 μm and preferably 5 to 20 μm.

EXAMPLES

The present invention will be described in detail below with reference to the following non-limiting Examples and Comparative examples.

Examples 1 to 10

1,2,3-Trimethylbenzene, 1,2,4-trimethylbenzene and 1,2,3,4-tetrahydronaphthalene as high boiling point aromatic hydrocarbon solvents were blended, in the mixing ratio specified in the following Table 1, with a bath prepared by melt blending $AlCl_3$ (481 g/l) and 1-methyl-3-propylimidazolium bromide (64.7 g/l) (at a molar ratio of 2:1) and then zirconium chloride was added to the resulting blend in each corresponding ratio as specified in the following Table 1 to thus give an electric Al—Zr alloy plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity: 99.9%) as an anode, these electrodes were immersed in the foregoing electric Al—Zr alloy plating bath maintained at 50° C. in a dry nitrogen gas atmosphere for 5 minutes and then the Al—Zr alloy plating was carried out using a direct current or a pulsed current (duty ratio=1:1; ON time: 10 ms; and OFF time: 10 ms). In this respect, the plating bath was stirred using a stirrer. In these Examples, the electric plating was carried out while variously changing the concentrations of 1,2,3-trimethylbenzene, 1,2,4-trimethyl-benzene and 1,2,3,4-tetrahydronaphthalene in the plating bath, the concentration of zirconium chloride in the bath and the electrolysis conditions, and the resulting electric Al—Zr alloy plated films were inspected for the rate of the co-deposited Zr (%), the smoothness, the adhesive properties (adhesion) and the corrosion resistance. The results thus obtained in such evaluation procedures as well as the flash points of the resulting plating baths are summarized in the following Table 2.

TABLE 1-1

(Thickness of film: 8 μm)

| Ex. No. | Solvent (C) | Conc. Of Solvent (C) in the Bath (% by Vol.) | Flash Point of the Plating Bath (° C.) |
|---|---|---|---|
| 1 | 1,2,3-Trimethylbenzene | 10 | 67 |
| 2 | 1,2,4-Trimethylbenzene | 20 | 63 |
| 3 | 1,2,3,4-Tetrahydronaphthalene | 10 | 80 |
| 4 | 1,2,3,4-Tetrahydronaphthalene | 10 | 80 |
| 5 | 1,2,3,4-Tetrahydronaphthalene | 10 | 80 |
| 6 | 1,2,3,4-Tetrahydronaphthalene | 10 | 80 |
| 7 | 1,2,3,4-Tetrahydronaphthalene | 20 | 77 |
| 8 | 1,2,3,4-Tetrahydronaphthalene | 20 | 77 |
| 9 | 1,2,3,4-Tetrahydronaphthalene | 40 | 75 |
| 10 | 1,2,3-Trimethylbenzene + 1,2,3,4-Tetrahydronaphthalene | 10 + 10 | 65 |

TABLE 1-2

(Thickness of film: 8 μm)

| Ex. No. | $ZrCl_4$ (g/L) | Current | Current Density ($A/dm^2$) | Time (min) | Bath Temp. (° C.) |
|---|---|---|---|---|---|
| 1 | 5 | Direct Current | 4 | 20 | 50 |
| 2 | 5 | Direct Current | 4 | 20 | 50 |
| 3 | 1 | Direct Current | 2 | 40 | 50 |
| 4 | 5 | Pulsed Current | 4 | 40 | 50 |
| 5 | 10 | Pulsed Current | 4 | 40 | 50 |
| 6 | 10 | Direct Current | 4 | 20 | 50 |
| 7 | 5 | Direct Current | 1 | 80 | 50 |
| 8 | 5 | Pulsed Current | 6 | 30 | 50 |
| 9 | 5 | Direct Current | 2 | 40 | 50 |
| 10 | 5 | Pulsed Current | 2 | 40 | 50 |

TABLE 2

(Thickness of film: 8 μm)

| Ex. No. | Rate of Co-deposited Zr (%) | Smoothness, Ra (μm) | Adhesive Properties of Film | SST Corrosion res. Time Required for the formation of Red Rust (hr) |
|---|---|---|---|---|
| 1 | 27 | 1.0 | Free of any Peeling | 1000 |
| 2 | 26 | 1.0 | Free of any Peeling | 1000 |
| 3 | 12 | 3.0 | Free of any Peeling | 700 |
| 4 | 25 | 1.0 | Free of any Peeling | 1000 |
| 5 | 31 | 0.5 | Free of any Peeling | 1500 |
| 6 | 30 | 0.5 | Free of any Peeling | 1500 |
| 7 | 30 | 0.5 | Free of any Peeling | 1500 |
| 8 | 26 | 1.0 | Free of any Peeling | 1000 |
| 9 | 25 | 1.0 | Free of any Peeling | 1000 |
| 10 | 23 | 1.0 | Free of any Peeling | 1000 |

Examples 11 to 16

Twenty percent by volume of 1,2,4-trimethylbenzene, as a high boiling point aromatic hydrocarbon solvent, and 5 g/L of zirconium chloride were blended with a plating bath prepared by melt blending $AlCl_3$ (481 g/L) and 1-methyl-3-propylimidazolium bromide (64.7 g/L) (at a molar ratio of 2:1). Furthermore an organic polymer (D) and a brightening agent (E) were added to the resulting blend in each corresponding concentration as specified in the following Table 3 to thus give an electric Al—Zr alloy plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity: 99.9%) as an anode, these electrodes were immersed in the foregoing electric Al—Zr alloy plating bath maintained at 50° C. in a dry nitrogen gas atmosphere for 5 minutes and then the Al—Zr alloy plating was carried out using a direct current in the plating bath thus prepared. In this respect, the plating bath was stirred using a stirrer. In these Examples, the electric plating was carried out while variously changing the kinds and concentrations of the foregoing additives in the plating bath, and the electrolysis conditions as specified in the following Table 3 (the flash points of the baths are also shown in this Table), and the resulting electric Al—Zr alloy plated films were inspected for the rate of the co-deposited Zr (%), the smoothness, the adhesive properties and the corrosion resistance. The results thus obtained in such evaluation procedures are summarized in the following Table 4.

TABLE 3-1

(Thickness of Film: 8 μm)

| Ex. No. | Additive | Conc. Of Additive In the Plating bath | Flash Point of the Plating Bath (° C.) |
|---|---|---|---|
| 11 | (D) Polystyrene | 2.5 g/L | 63 |
| 12 | (D) Polystyrene | 5.0 g/L | 63 |
| 13 | (E) 1,10-Phenanthroline | 0.001 mole/L | 63 |
| 14 | (E) 1,10-Phenanthroline | 0.002 mole/L | 63 |
| 15 | (E) Isonicotinic acid Hydrazide | 0.004 mole/L | 63 |
| 16 | (E) Thiouracil | 0.002 mole/L | 63 |

TABLE 3-2

(Thickness of Film: 8 μm)

| Ex. No. | $ZrCl_4$ (g/L) | Current | Current Density ($A/dm^2$) | Time (min) | Bath Temp. (° C.) |
|---|---|---|---|---|---|
| 11 | 5 | Direct Current | 4 | 20 | 50 |
| 12 | 5 | Direct Current | 2 | 40 | 50 |
| 13 | 5 | Direct Current | 4 | 20 | 50 |
| 14 | 5 | Direct Current | 2 | 40 | 50 |
| 15 | 5 | Direct Current | 4 | 20 | 50 |
| 16 | 5 | Direct Current | 3 | 25 | 50 |

* Polystyrene: Piccolastic A75 (MW: 1300), available from Eastman Chemical Co., Ltd.

TABLE 4

(Thickness of Film: 8 μm)

| Ex. No. | Rate of Co-deposited Zr (%) | Smoothness, Ra (μm) | Adhesive Properties of Film | SST Corrosion res. Time Required for the formation of Red Rust (hr) |
|---|---|---|---|---|
| 11 | 27 | 0.8 | Free of any Peeling | 1500 |
| 12 | 26 | 0.5 | Free of any Peeling | 1500 |
| 13 | 25 | 0.8 | Free of any Peeling | 1500 |
| 14 | 27 | 0.5 | Free of any Peeling | 1500 |
| 15 | 25 | 0.7 | Free of any Peeling | 1500 |
| 16 | 25 | 0.8 | Free of any Peeling | 1500 |

Comparative Examples 1 to 3

An organic polymer (D) and a brightening agent (E) were added, in amounts specified in the following Table 5, to a bath prepared by melt blending $AlCl_3$ (481 g/L) and 1-methyl-3-propylimidazolium bromide (64.7 g/L) (at a molar ratio of 2:1) to thus give each corresponding electric Al-plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity: 99.9%) as an anode, these electrodes were immersed in the foregoing electric Al-plating bath maintained at 50° C. in a dry nitrogen gas atmosphere for 5 minutes and then the Al-plating was carried out using a direct current in the plating bath thus prepared. In this respect, the plating bath was stirred using a stirrer. In these Comparative Examples, the electric plating was carried out while variously changing the kinds and concentrations of the foregoing additives in the plating bath, and the electrolysis conditions as specified in the following Table 5 (the flash points of the baths are also shown in this Table), and the resulting electric Al-plated films were inspected for the smoothness, the adhesive properties and the corrosion resistance. The results thus obtained in such evaluation procedures are summarized in the following Table 6.

TABLE 5-1

(Thickness of Film: 8 μm)

| Comp. Ex. No. | Additive | Conc. Of Additive In the Plating bath | Flash Point of the Plating Bath (° C.) |
|---|---|---|---|
| 1 | No Additive | 0 | Not Detected |
| 2 | (D) Polystyrene | 5.0 g/L | Not Detected |
| 3 | (E) 1,10-Phenanthroline | 0.002 mole/L | Not Detected |

* Polystyrene: Piccolastic A75 (MW: 1300), available from Eastman Chemical Co., Ltd.

TABLE 5-2

(Thickness of Film: 8 μm)

| Comp. Ex. No. | $ZrCl_4$ (g/L) | Current | Current Density ($A/dm^2$) | Time (min) | Bath Temp. (° C.) |
|---|---|---|---|---|---|
| 1 | 0 | Direct Current | 4 | 20 | 50 |
| 2 | 0 | Direct Current | 4 | 20 | 50 |
| 3 | 0 | Direct Current | 4 | 20 | 50 |

TABLE 6

(Thickness of Film: 8 μm)

| Comp. Ex. No. | Rate of Co-deposited Zr (%) | Smoothness Ra (μm) | Adhesive Properties of Film | SST Corrosion res. Time Required for the formation of Red Rust (hr) |
|---|---|---|---|---|
| 1 | 0 | 4.00 | Free of any Peeling | 120 |
| 2 | 0 | 1.00 | Free of any Peeling | 480 |
| 3 | 0 | 0.50 | Free of any Peeling | 480 |

Comparative Examples 4 and 5

Zirconium chloride (5 g/L) was added to a bath prepared by melt blending $AlCl_3$ (481 g/L) and 1-methyl-3-propylimidazolium bromide (64.7 g/L) (at a molar ratio of 2:1) to thus give each corresponding electric Al—Zr alloy plating bath, without addition of any high boiling point aromatic hydrocarbon solvent. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity: 99.9%) as an anode, these electrodes were immersed in the foregoing electric Al—Zr alloy plating bath maintained at 50° C. in a dry nitrogen gas atmosphere for 5 minutes and then the Al—Zr alloy plating was carried out using a direct current in the plating bath thus prepared. In this respect, the plating bath was stirred using a stirrer. In these Comparative Examples, the electric plating was carried out while variously changing the kinds and concentrations of the foregoing additives in the plating bath, and the electrolysis conditions as specified in the following Table 7 (the flash points of the baths are also shown in this Table), and the resulting electric Al—Zr alloy plated films were inspected for the rate of the co-deposited Zr (%), the smoothness, the adhesive properties and the corrosion resistance. The results thus obtained in such evaluation procedures are summarized in the following Table 8.

TABLE 7-1

(Thickness of Film: Not Determined)

| Comp. Ex. No. | Additive | Conc. Of Additive In the Plating bath | Flash Point of the Plating Bath (° C.) |
|---|---|---|---|
| 4 | No Additive | 0 | Not Detected |
| 5 | (D) Polystyrene | 5.0 g/L | Not Detected |

* Polystyrene: Piccolastic A75 (MW: 1300), available from Eastman Chemical Co., Ltd.

TABLE 7-2

(Thickness of Film: Not Determined)

| Comp. Ex. No. | $ZrCl_4$ (g/L) | Current | Current Density ($A/dm^2$) | Time (min) | Bath Temp. (° C.) |
|---|---|---|---|---|---|
| 4 | 5 | Direct Current | 1 | 80 | 50 |
| 5 | 5 | Direct Current | 0.5 | 150 | 50 |

TABLE 8

(Thickness of Film: Not Determined)

| Comp. Ex. No. | Rate of Co-deposited Zr (%) | Smoothness Ra (μm) | Adhesive Properties of Film | SST Corrosion res. Time Required for the formation of Red Rust (hr) |
|---|---|---|---|---|
| 4 | 13 | 2.00 | Free of any Peeling[1)] | 24 |
| 5 | — | — | Free of any Plated Layer | — |

[1)]There were observed the presence of portions free of any plated layer.

Comparative Example 6

The same procedures used in Example 1 were repeated except that 1,2,3-trimethylbenzene as a high boiling point solvent was substituted for the same amount of toluene to thus prepare an electric Al—Zr alloy plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity: 99.9%) as an anode, these electrodes were immersed in the foregoing electric Al—Zr alloy plating bath maintained at 50° C. in a dry nitrogen gas atmosphere for 5 minutes and then the Al—Zr alloy plating was carried out using a direct current in the plating bath thus prepared. In this respect, the plating bath was stirred using a stirrer. In this Comparative Example, the electric plating was carried out under the electrolysis conditions as specified in the following Table 9 (the flash point of the bath is also shown in this Table), and the resulting electric Al—Zr alloy plated film was inspected for the rate of the co-deposited Zr (%), the smoothness, the adhesive properties and the corrosion resistance. The results thus obtained in such evaluation procedures are summarized in the following Table 10.

TABLE 9-1

(Thickness of Film: 8 μm)

| Comp. Ex. No. | Additive | Conc. Of the Solvent In the Plating bath | Flash Point of the Plating Bath (° C.) |
|---|---|---|---|
| 6 | Toluene | 10 | 40 |

TABLE 9-2

(Thickness of Film: 8 μm)

| Comp. Ex. No. | $ZrCl_4$ (g/L) | Current | Current Density ($A/dm^2$) | Time (min) | Bath Temp. (° C.) |
|---|---|---|---|---|---|
| 6 | 5 | Direct Current | 4 | 20 | 50 |

TABLE 10

(Thickness of Film: 8 μm)

| Comp. Ex. No. | Rate of Co-deposited Zr (%) | Smoothness Ra (μm) | Adhesive Properties of Film | SST Corrosion res. Time Required for the formation of Red Rust (hr) |
|---|---|---|---|---|
| 6 | 21 | 1.5 | Free of any Peeling | 1000 |

(Method for the Determination of Rate of Co-Deposited Zr (%) and Thickness of Plated Film)

The rate of the co-deposited Zr (%) and the thickness of the resulting Al—Zr alloy plated film were determined using an X-ray fluorescence spectrometer (Micro-Element Monitor SEA5120 available from SII-Nanotechnology Co., Ltd.).

(Method for the Determination of Time Required for Generating Red Rust on SST)

The time required for the generation of red rust on SST was determined according to the salt spray test (JIS Z2371).

(Method for the Determination of Smoothness)

The smoothness of the resulting plated film was determined using a surface roughness-measuring device (Surf-Coder SE-30H available from KOSAKA Laboratory Co., Ltd.).

(Method for Determining Adhesion)

The adhesion of the resulting plated film was evaluated according to the tape-peeling test. The tape-peeling test was carried out by bending a substrate at an angle of 180 degs. with the surface carrying the alloy plated film inside, then returning the substrate to the original state, adhering an adhesive cellophane tape (having a width of 18 mm and specified in JIS Z1522) to the bent portion of the substrate while pressing the same against the substrate with an eraser (specified in JIS S6050), thereafter instantaneously peeling the tape by pulling one end thereof maintained at a right angle to the adhered surface within 90 seconds from the application of the tape to the substrate and visually observing the film and judging whether the film was peeled off or not.

(Method for the Determination of Flash Point of Plating Bath)

The flash point of the resulting plating bath was determined by the test method for the flash points of hazardous substances belonging to Group 4 according to the manual for practicing the hazardous substance-confirming test specified in the Fire Service Law.

The invention claimed is:

1. An electric Al—Zr alloy plating bath which comprises (A) an aluminum halide; (B) one kind of compound or at least two kinds of compounds selected from the group consisting of N-alkylpyridinium halides, N-alkylimidazolium halides, N,N'-dialkylimidazolium halides, N-alkyl-pyrazolium halides, N,N'-dialkylpyrazolium halides, N-alkylpyrrolidinium halides and N,N-dialkyl-pyrrolidinium halides; (C) a high boiling point alkyl-substituted and/or hydroxyl-substituted aromatic hydrocarbon solvent, selected from one of 1,2,3-trimethylbenzene, or 1,2,3,4-tetrahydronaphthalene, and having a boiling point of not less than 160° C.; and (F) a zirconium salt, wherein the molar ratio of the aluminum halide (A) to the compound (B) ranges from 1:1 to 3:1, the concentration of the high boiling point aromatic hydrocarbon solvent is from 5 to 50% by volume, the concentration of the zirconium salt in the plating bath ranges from 1 to 20 g/L and the flash point of the plating bath is not less than 61° C.

2. The electric Al—Zr alloy plating bath as set forth in claim 1, wherein the plating bath comprises the high boiling point aromatic hydrocarbon solvent (C) in an amount ranging from 5% to 25% by volume of the bath.

3. The electric Al—Zr alloy plating bath as set forth in claim 1, wherein the plating bath further comprises (D) one kind of organic polymer or at least two kinds of organic polymers selected from the group consisting of styrenic polymers and aliphatic diene-derived polymers in a concentration ranging from 0.1 to 50 g/L.

4. The electric Al—Zr alloy plating bath as set forth in claim 1, wherein the plating bath further comprises (E) a brightening agent in a concentration ranging from 0.001 to 0.1 mole/L.

5. An electro-plating method comprising preparing an electric Al—Zr alloy plating bath as set forth in claim 1, and electro-plating a material therein.

6. The plating method as set forth in claim 5, further comprising carrying out the electric plating with a pulsed current.

* * * * *